United States Patent [19]

Terry

[11] 4,244,100

[45] Jan. 13, 1981

[54] APPARATUS FOR MAKING A FIBER BED ELEMENT

[75] Inventor: Alvah B. Terry, St. Louis, Mo.

[73] Assignee: Monsanto Company, St. Louis, Mo.

[21] Appl. No.: 33,367

[22] Filed: Apr. 25, 1979

[51] Int. Cl.[3] ..... B23P 21/00; B28B 1/04; B65H 54/84

[52] U.S. Cl. ..... 29/714; 425/431; 28/289; 29/419 R; 29/163.5 R

[58] Field of Search ..... 19/159 R; 28/289; 29/419 R, 419 G, 714, 163.5 R, 455 R; 53/527, 545, 535; 242/47, 79, 81, 82, 83, 174, 176, 178; 425/431

[56] References Cited

U.S. PATENT DOCUMENTS

| | | | |
|---|---|---|---|
| 911,757 | 2/1909 | Raber et al. | 425/431 |
| 3,159,902 | 12/1964 | Mertens | 28/289 |
| 4,142,280 | 3/1979 | Feffer | 19/159 R |

*Primary Examiner*—Francis S. Husar

*Assistant Examiner*—J. A. Bacsalmassy

*Attorney, Agent, or Firm*—Lawrence L. Limpus

[57] ABSTRACT

Apparatus for making a fiber bed element made up of a roving of fibers axially packed in the annulus formed by a pair of concentric screens, wherein structure is provided for holding and rotating the screens in a concentric positioning on the lowermost of a pair of vertically aligned platforms. A roving of staple fibers is fed into the annulus through a tube supported by the upper platform and a packing mechanism mounted on the upper platform packs the roving as it is fed into the annulus. The lower platform is moved downward as the roving is fed into the annulus, in order to maintain a uniform packing force.

Downward movement of the lower platform is controlled by a control system which senses packing force and moves the lower platform downward in response to this packing force to maintain a uniform packing density.

5 Claims, 1 Drawing Figure

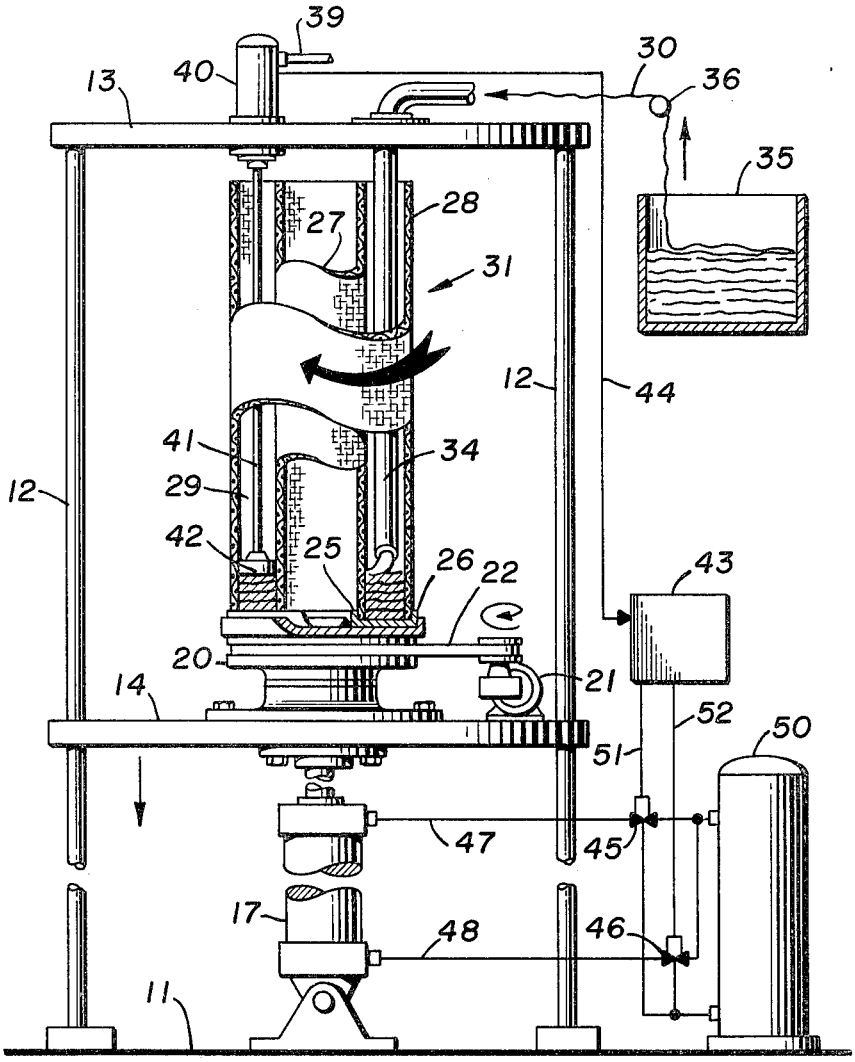
39
40
13
30
36
35
28
27
31
12
44
41
34
29
12
42
25
26
22
43
20
21
14
52
50
51
47
45
17
48
46
11

APPARATUS FOR MAKING A FIBER BED ELEMENT

BACKGROUND OF THE INVENTION a. Field of the Invention

This invention relates to apparatus for making fiber bed elements.

b. Description of the Prior Art

It is known to make a fiber bed element which is useful for removing mists or aerosols from gas streams by packing randomly distributed fibers in the annulus formed by two concentric screens. This process involves large amounts of labor and time. Also, it is very difficult to obtain a uniform packing density in the fibers making up the fiber bed element. In order to compensate for uneven packing densities in such a fiber bed element, it has usually been necessary to make the element significantly thicker in order to prevent gas channeling and lowered efficiencies. This results in the use of more fiber and a higher pressure drop across the element. The additional fiber required increases manufacturing cost and the greater pressure drop requires more energy to drive the gas through the element.

The apparatus of the present invention produces a fiber bed element having a very uniform packing density throughout the element with the use of a minimum of fiber and requires significantly less time and labor to produce the element.

SUMMARY OF THE INVENTION

Apparatus for making a fiber bed element made up of a roving of staple fibers packed in the annulus formed by a pair of concentric screens, wherein the screens are mounted for rotation on a lower platform which is movable in a vertical direction. A roving of staple fibers is fed into the annulus formed by the concentric screens and a packing mechanism secured to an upper platform extends into the annulus to pack the roving as the screens are being rotated. A control system is provided for sensing the packing force applied to the fibers and lowering the lower platform and the rotating screens to maintain a uniform packing force as the roving fills the annulus between the two screens.

DESCRIPTION OF THE DRAWING

The single view is a side view of the apparatus of the invention showing the positioning of the various elements of the invention.

DETAILED DESCRIPTION OF THE INVENTION

Referring now in detail to the drawing there is shown a base 11 supporting a plurality of guide rods 12 which extend vertically upward from the base and which support a stationary upper platform 13. A lower platform 14 is slidably mounted on the guide rods 12 below and in vertical alignment with the upper platform 13 and is connected to a cylinder 17 which is adapted to move the lower platform 14 vertically toward or away from the stationary platform 13.

The lower platform 14 supports a turntable 20 which is driven by combination motor speed-reduction drive unit 21 mounted on the lower platform 14 and acting through a belt 22. The turntable 20 is provided with concentric flanges 25 and 26 which support foraminous cylindrical screens 27 and 28 in a concentric relationship. Preferably, the screens 27 and 28 are made of wire mesh. The screens 27 and 28 form an annulus 29 in which a staple fiber roving 30 is packed to form a fiber bed element 31.

The staple fiber roving 30 is fed downward through a tube 34 secured to the upper platform 13 and having its lower end positioned in the annulus 29 for feeding the roving into this annulus, the tube 34 having its lower end curved in the direction of travel of the screens. The roving is supplied from a container 35 adjacent to the upper platform 13 and is passed over an air bearing 36 before entering the tube 34.

The weight of the roving, in addition to a slight tension applied by the moving screens, pulls the roving through the tube 34 to be deposited in the annulus 29. The apparatus applies very little tension to the roving, so that there is no danger of breaking the roving.

It can readily be seen that the roving is fed into the annulus at a very uniform rate. This contributes to uniformity in the bed element made on this apparatus.

The roving 31 may be made up of staple fibers of various materials, such as polymeric materials such as nylons and polyesters, metals such as stainless steel and titanium, ceramic materials and glass. The only requirement is that the fibers be not too stiff and/or brittle to be packed in this manner. Fiber brittleness and stiffness is reduced as fiber densities is reduced. Glass is a preferred fiber because of its resistance to chemical attack. If glass is used for making the fibers, the fibers should have a mean diameter of 5 to 50 microns, with a preferred mean diameter in the range of 5–15 microns. The roving is packed in the annulus 29 to a density in the range of 80 to 320 Kg per cubic meter.

A hammer 40 of a well known type mounted on the upper platform 13 is provided with a rod 41 connected to the piston (not shown) of the hammer and extending into the annulus 29 as illustrated in the drawing. The hammer 40 is actuated by a fluid under pressure, such as compressed air supplied through a line 39. A packing foot or element 42 secured to the lower end of the rod 41 is provided for packing the roving 30 as the screens 27 and 28 are rotated. The packing element 42 is reciprocated at a high rate of speed relative to the speed of rotation of the screens, so that no provision need be made for lateral movement of the element 42. A slight flexing of the rod 41 will take into account the movement of the screens 27 and 28.

A control system 43 of a well known, commercially available, type senses the fluid pressure in the hammer 40 through a line 44 to sense the packing force applied to the roving by the packing element 42, this fluid pressure being proportional to the packing force. As more roving is fed into the annulus 29 the packing force will steadily increase to undesirably high values, unless the screens 27 and 28 are moved downward. The control unit 43 senses the increasing fluid pressure and, when a predetermined upper limit is reached, acts through control lines 51 and 52 to actuate three way valves 45 and 46 in lines 47 and 48, respectively, leading from a suitable source of compressed fluid 50 to the cylinder 17 to cause the cylinder 17 to lower the platform 14. The cylinder 17 then lowers the platform 14 to lower the screens 27 and 28 to maintain the packing force applied to the roving within the desired range.

It can readily be seen that the control unit 43 continuously senses the fluid pressure in the hammer 40 and continually lowers the platform 14 to keep the pressure in the hammer 40, and the packing force applied to the roving, within a desired range. A very uniformly packed fiber bed element can be produced in this manner, with the use of a minimum amount of fiber.

In operation, the screens are positioned on the turntable 20 and continuously rotated by the drive unit 21 as the staple roving is fed into the annulus 29 through the tube 34. The hammer 40 reciprocates the packing element 40 at a high rate of speed to compact the roving to the desired density between the two screens.

As the roving builds up in the annulus 29, the fluid pressure in the hammer 40 will increase. This increase in pressure in the hammer 40 will be sensed by the control unit 43, which then actuates the three way valves 45 and 46 to cause the cylinder 17 to lower the platform 14. Lowering the platform 14 causes the packing force to be decreased. In this manner, the packing force applied to the roving 30 is very uniform throughout the formation of the fiber bed element. Inasmuch as the roving 30 is fed into the annulus 29 at a constant rate, a very uniformly packed fiber bed element is produced with a minimum amount of fiber.

The fiber bed element made by this apparatus is useful for removing mists or aerosols from a gas stream. The gas stream is passed radially through the element. Mist droplets which contact fibers in the element are captured. The moving gas urges the droplets toward the downstream surface of the element, where the droplets coalesce and drain by gravity down to a collection point.

What is claimed is:

1. Apparatus for making a fiber bed element made up of a roving of fibers packed in the annulus formed by a pair of concentric screens, comprising:

a. upper and lower platforms positioned in vertical alignment, the lower platform being movable vertically relative to the upper platform.

b. rotatable means on the lower platform for supporting the screens in a concentric positioning, c. means connected to the rotatable supporting means for rotating said screens, d. means positioned above the screens and extending into the annulus for feeding a roving of fibers into said annulus, e. means mounted above the screens and extending into said annulus for packing said roving in said annulus, f. fluid-actuated means connected to the packing means for sensing the packing force applied to the fibers by the packing means.

g. means connected to the lower platform for moving said platform vertically away from the upper platform as said roving is fed into said annulus, and h. means connected to the control means and the moving means for controlling said moving means to maintain a uniform packing force as said annulus is filled with fiber.

2. The apparatus of claim 1 wherein said platform moving means is a fluid-actuated cylinder.

3. The apparatus of claim 2 wherein the packing means is a hammer having a packing foot adapted to be positioned in said annulus for packing said roving.

4. Apparatus for making a fiber bed element made up of a roving of staple fibers packed into the annulus formed by a pair of concentric screens, comprising:

a. a plurality of vertical guides, b. a first stationary platform mounted above the guides, c. a second platform positioned below the first platform, said second platform being mounted for vertical movement along said guides, d. a turntable rotatably mounted on the second platform, said turntable having a pair of concentric flanges for holding the screens in a concentric position, e. means on the second platform for rotating the turntable to rotate the screens, f. a tube mounted on the first platform and extending downward into said annulus for feeding the roving into the annulus formed by the screens, g. a fluid-actuated hammer mounted on the first platform and having a packing element positioned to extend into said annulus to pack said roving, h. a fluid-actuated cylinder connected to the second platform for raising and lowering said second platform, i. means connected to the fluid-actuated cylinder for actuating said cylinder, and j. control means for sensing the force applied by the packing element and controlling the fluid-actuated cylinder actuating means to lower the second platform to move the screens downward when said force exceeds a predetermined value.

5. The apparatus of claim 4 wherein the lower end of said tube is curved in the direction of movement of the screens.

* * * * *